United States Patent [19]

Surman

[11] 4,120,121

[45] Oct. 17, 1978

[54] METHOD AND APPARATUS FOR COLLECTING PRECIOUS METAL PARTICLES

[75] Inventor: Stuart A. Surman, 442 Silver Avenue, Southampton, Pa. 18966

[73] Assignee: Stuart A. Surman, Southampton, Pa.

[21] Appl. No.: 768,587

[22] Filed: Feb. 14, 1977

[51] Int. Cl.[2] ..... B24B 55/06

[52] U.S. Cl. ..... 51/270; 51/281 R

[58] Field of Search ..... 51/270, 267, 281 R; 29/DIG. 50

[56] References Cited

U.S. PATENT DOCUMENTS

| | | | |
|---|---|---|---|
| 1,797,261 | 3/1931 | Hallman | 51/270 |
| 2,111,782 | 3/1938 | Hudson | 51/270 |
| 3,032,940 | 5/1962 | Sutton | 51/270 |
| 3,651,607 | 3/1972 | Lee | 51/270 |

FOREIGN PATENT DOCUMENTS

| | | | |
|---|---|---|---|
| 897,214 | 11/1953 | Fed. Rep. of Germany | 51/267 |
| 222,189 | 10/1968 | U.S.S.R. | 51/267 |

*Primary Examiner*—Harold D. Whitehead
*Assistant Examiner*—Roscoe V. Parker
*Attorney, Agent, or Firm*—Weiser, Stapler & Spivak

[57] ABSTRACT

An apparatus for collecting gold and other precious metal dust comprising an enclosure defining a working area within which is positioned a rotating, work contacting wheel, an abrasive belt or vibrating abrasive plates. The enclosure comprises a transparent back, a rearwardly slanted floor, spaced sides and a forwardly slanted top having a reflecting under-surface. A lamp mounts exteriorly of the back in position to direct light rays to the under-surface for reflection upon the working area. A pump delivers water from a reservoir to a multi-outlet flow control fitting having a valved nozzle outlet, a valved wash outlet and a free flowing jet return outlet. Hoses are connected respectively to the outlets for work wetting, enclosure cleaning and drain clearing purposes.

17 Claims, 3 Drawing Figures

FIG. 1
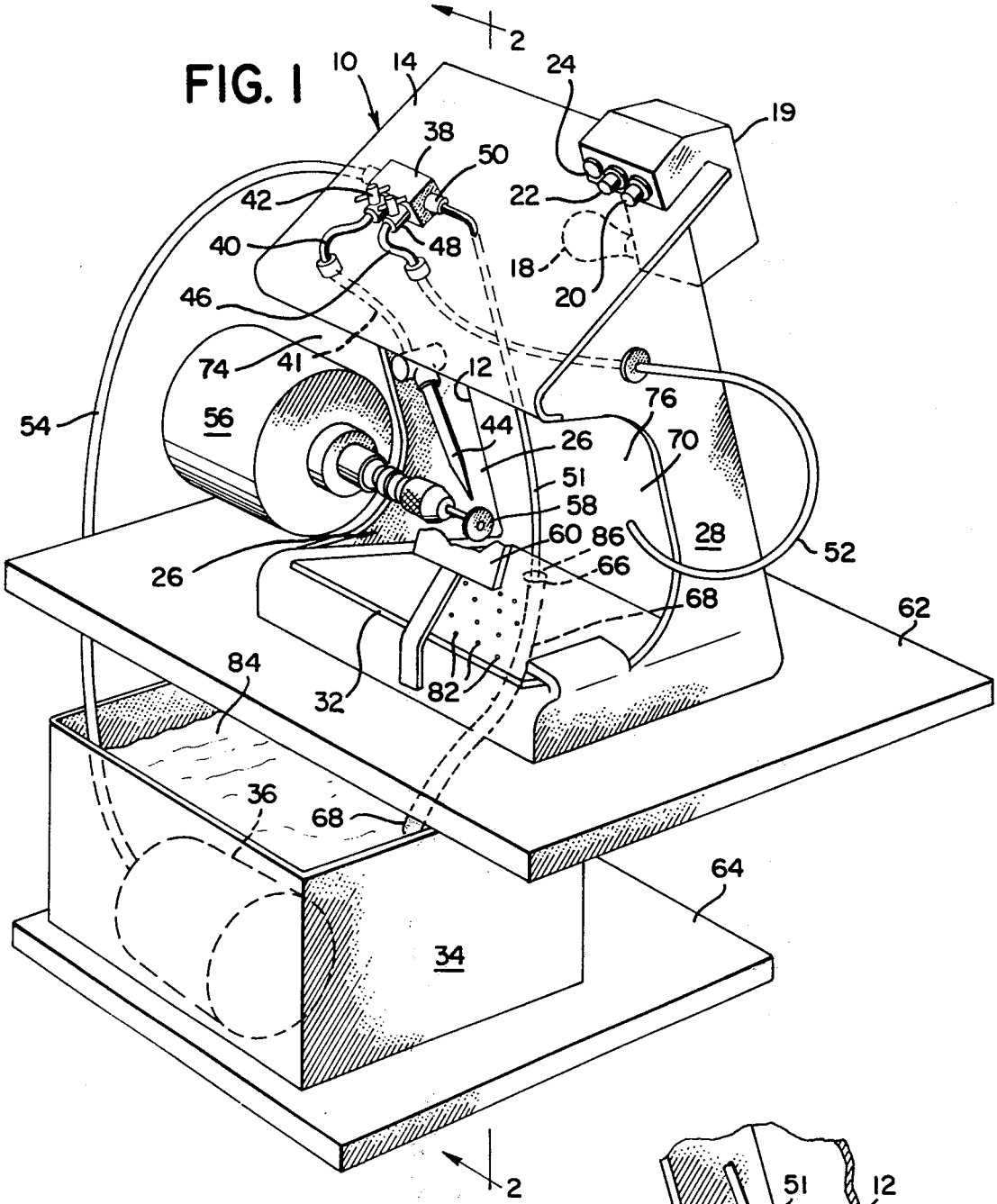
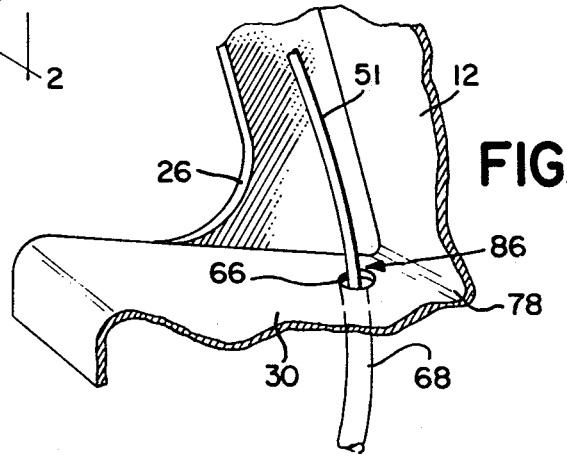
FIG. 3

METHOD AND APPARATUS FOR COLLECTING PRECIOUS METAL PARTICLES

BACKGROUND OF THE INVENTION

This invention relates generally to the field of wet process dust collecting systems and more particularly, is directed to a wet method and apparatus suitable for collecting precious metal particles, such as gold dust and the like.

In numerous industries, for example, jewelry making and the manufacture of certain dental appliances, it is the usual practice to grind, shape, buff, polish and otherwise treat articles which are formed of valuable materials, for example, diamonds, gold and other precious metals. Such shaping, grinding and polishing operations are usually performed by utilizing rotating power driven devices in laboratories having equipment suitable for working such precious metals or stones. In the course of these operations, small particles and dust are normally formed of the valuable materials. Unless efficient and usually costly dust control procedures are employed, considerable quantities of costly metals can be lost as dust.

Prior workers in the art have recognized the value of dust resulting from the work and have developed apparatus and methods in attempts to control the dust to thereby recover a greater percentage of the valuable waste materials developed during the manufacturing processes. The devices and methods disclosed in U.S. Pat. Nos. 1,007,272, 1,254,111, 1,340,213, 1,374,075, 2,111,782, 3,389,797 and 3,651,607 are exemplary illustrations of the attempts of prior workers in the field to produce an acceptable apparatus and method.

However, despite the development efforts of the prior workers in the field, there still has not been produced an entirely satisfactory, relatively inexpensive, efficient collecting device suitable to collect valuable minute particles to minimize the loss of expensive precious metal or other particles, for example, gold dust.

SUMMARY OF THE INVENTION

The present invention relates to a method and apparatus for collecting precious metal or other valuable particles, and more particularly, is directed to an apparatus employing a wet process for dust control purposes.

The apparatus of the present invention includes a work station that is open to the front and which is defined between a pair of spaced side plates which are shaped both to facilitate access to the working area and also to retain and restrain valuable particles within the apparatus itself. The side plates terminate rearwardly in a rear shield that preferably is fabricated of clear, transparent plastic of sufficient rigidity and body to retain dust, small particles and liquid streams that may be directed thereagainst.

The top of the apparatus is enclosed with a forwardly sloping roof which preferably is opaque to light and which has a reflective under surface suitable for light reflection purposes. A lamp or other source of illumination mounts rearwardly of the enclosure in position to direct light rays through the clear plastic back to impinge upon the reflecting under surface of the enclosure top, which surface may be a mirror.

The angular inclination of the mirrored under surface serves to reflect the light rays directly upon the working area. Additionally, the height of the work station is designed to normally position the enclosure roof between the worker's line of vision and the lamp so that the worker's eyes will normally be shielded from direct viewing of the lamp or other source of illumination, without in any way detracting from the amount of light actually falling upon the work piece as the grinding or buffing operations are performed.

The floor of the enclosure slopes rearwardly to a rearwardly positioned drain which is installed at the low point of the enclosure. A tank or water reservoir is positioned below the enclosure and receives the effluent through the enclosure drain in a gravity discharge. A pump draws liquid from the reservoir and directs the liquid into a flow control fitting which may be positioned interiorly or exteriorly of the work space defined within the enclosure. In a preferred embodiment, the flow control fitting includes a water inlet from the pump and three water outlets, namely, a valved outlet to feed a nozzle which is positioned to direct a liquid stream directly upon the work piece, a valved wash outlet which is employed to supply liquid to an interior surface washing down hose, and, a nonvalved outlet which continuously feeds a liquid stream through a jet return hose to the drain in an indirect connection. The jet return hose stream acts to prime the drain in a manner to overcome surface tension, particle obstruction or other conditions which may tend to retard or discourage gravity liquid return from the enclosure to the reservoir.

It is therefore an object of the present invention to provide an improved method and apparatus for collecting precious metal or other particles of the type set forth.

It is another object of the present invention to provide an improved wet process for collecting dust which incorporates a novel buffing hood or work bench including integral liquid distribution means.

It is another object of the present invention to provide a novel wet process and apparatus for collecting dust which incorporates a buffing hood or work bench, comprising a forwardly sloping roof, a rearwardly sloping floor and a pair of spaced sides interconnecting the roof and floor.

It is another object of the present invention to provide a novel wet process for collecting dust which comprises a work bench having illumination means mounted exteriorly of the work bench, means to reflect rays from the illuminating means upon the work area, and means to protect the operator from directly viewing the light rays.

It is another object of the present invention to provide a novel method and apparatus for collecting precious metal particles which comprises an enclosure, drain means positioned at the low point of the enclosure to drain liquid into a lower reservoir, a pump directing liquid from the reservoir to a flow control fitting, said flow control fitting having outlets to meter liquid to a nozzle which directs a stream upon the work piece, to meter liquid to a hose suitable for cleaning the inside of the enclosure and to feed a jet return hose which continuously functions to direct a stream into the apparatus return drain.

It is another object of the present invention to provide a novel wet process and apparatus for collecting dust which comprises continuous liquid flow both from a liquid reservoir and to a liquid reservoir wherein jet return means responsive to pump operation are employed to facilitate gravity return flow from the enclosure into the reservoir.

It is another object of the present invention to provide a novel apparatus for collecting precious metal particles that is inexpensive in manufacture, simple in design and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 1 is a perspective view showing the apparatus of the invention in place upon a table.

FIG. 3 is an enlarged, partial, perspective view of the enclosure drain.

DESCRIPTION OF THE PREFERRED EMBODIMENTS OF THE INVENTION

Figure 2:
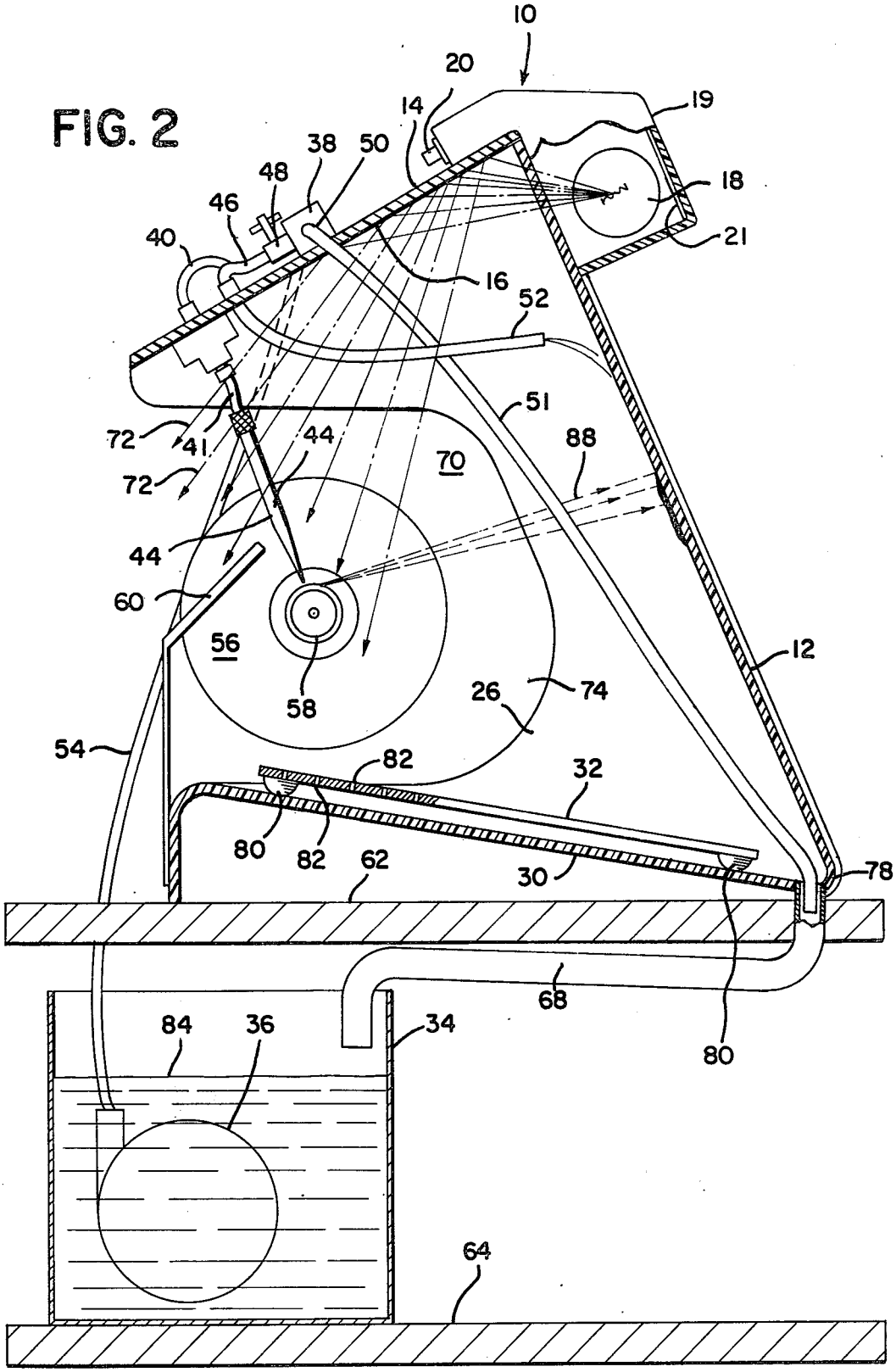
FIG. 2 is a cross sectional view taken along line 2—2 of FIG. 1, looking in the direction of the arrows.

Although specific terms are used in the following description for the sake of clarity, these terms are intended to refer only to the particular structure of the invention selected for illustration in the drawings and are not intended to define or limit the scope of the invention.

Referring now to the drawings, there is shown an apparatus 10 for collecting precious metal particles or dust resulting from grinding, buffing, polishing or similar operations which may be performed within the space 70 defined between the rear panel 12, the roof 14, the apparatus floor 30 and the respective left and right side panels 26, 28. A motor 56 is conventionally mounted on a work table 62 or upon the apparatus itself in conventional manner to position a buffing, polishing or grinding wheel 58 within the interior space 70. The apparatus further includes means to direct a flow of liquid interiorly which comprises in part a flow control fitting 38 and a liquid containing tank or reservoir 34 which is positioned below the apparatus floor 30 to receive gravity discharge of the liquid 84 utilized in the dust collecting process through the drain opening 66. Water from the reservoir is pumped through the flow control fitting and is employed to concentrate the dust at the enclosure walls and floor. As illustrated, the tank or reservoir 34 is positioned below the work table 62 and may rest upon a separate shelf 64. The tank 34 optionally could be installed upon the work table 62 intermediate the bottom of the apparatus 10 and the work table 62. Other work contacting devices such as abrasive belts or vibrating abrasive plates of known design could also be utilized in place of the wheel 58 for work contacting purposes.

As best seen in FIGS. 1 and 2, the rear wall or back 12 is planar in configuration and may incline forwardly toward the work wheel 58. The back panel 12 preferably is fabricated of clear, rigid transparent plastic to permit light rays from an exteriorly positioned illumination means or lamp 18 to pass therethrough. Preferably the lamp 18 is mounted exteriorly of the apparatus both to protect the lamp from the effects of the wet atmosphere normally present within the apparatus interior space 70 and also to shield the worker and the work piece from heat which may be generated by the illumination means 18.

As illustrated in FIG. 2, the lamp 18 is preferably enclosed within an opaque plastic housing 19 which is positioned exteriorly of the apparatus back panel 12. The housing 19 acts to confine the light rays emitted from the lamp 18 and to direct the light rays towards the reflecting surface 16 provided upon the underside of the apparatus roof panel 14. In a preferred embodiment, the interior of the housing 19 is also provided with a reflecting surface 21 to further aid in directing light rays interiorly to the work area.

The roof panel 14 is also planar in configuration and intersects the top of the plastic back 12 at an angle that is substantially a right angle. As best seen in FIG. 2, the roof panel 14 declines downwardly from the back 12 towards the worker (not shown) who will use the apparatus and is so positioned to normally shield the eyes of the worker from rays eminating from the light source 18. The underside of the roof surface is suitably treated to provide a reflecting surface 16 for reflection of the light rays emitted by the illumination means 18. The reflecting surface 16 may be a mirror, polished metal, suitable plastic or other known reflecting surface suitable for the purpose. Rays of light emitted by the illumination means 18 strike the mirrored surface 16 and are reflected downwardly and forwardly in the directions indicated by the arrows 72 to fully illuminate the work area as represented by the grinding or buffing wheel 58. The light rays from the lamp 18 are directed and reflected upon the work area for work illumination purposes and do not interfere with the vision of the worker performing the grinding, buffing or polishing operations by direct impingement.

The lamp or illumination means 18 may be conventionally controlled by a light switch 20 which also preferably is mounted exteriorly of the apparatus. The respective left and right side walls 26, 28 extend forwardly from the rear panel 12 and are cut out or otherwise shaped to define left and right access areas 74, 86 to permit the workman (not shown) to have fullest access to the interior space 70 for grinding, polishing, buffing cleaning and other operations normally performed within the apparatus 10.

The floor 30 of the unit, as best seen in FIG. 2, slopes downwardly rearwardly and joins the back panel 12 in an integral, transverse junction 78 which serves to prevent the escape of liquid or dust particles at the interconnection between the rear or back wall 12 and the floor 30. The junction 78 is also employed to concentrate and to drain liquid and particles from the interior space 30. A removable tray 32 rests upon the surface of the floor 30 and is spaced therefrom by a plurality of downwardly depending feet 80. The tray 32 is perforated with a plurality of holes 82 to permit liquid and dust particles to pass therethrough to fall upon the surface of the apparatus floor 30. It will be noted that the tray 32 also slopes rearwardly downwardly toward the junction 78 inasmuch as the tray rests upon the floor 30. The rearward slope of the tray 32 also aids in conveying liquid and dust particles toward the junction 78 during the precious metal dust collecting process by allowing liquid and particles to either flow rearwardly over the tray surface or downwardly through the holes 82.

Still referring to FIGS. 1 and 2, it will be noted that a quantity of liquid 84, such as water, is retained within the tank or reservoir 34. A pump 36, which may be of the submersible type, draws its suction from within the tank 34 and discharges its effluent through the pump discharge line 54 into a higher positioned, multi-port, flow control fitting 38. Preferably, the fitting 38 mounts exteriorly of the apparatus 10 upon the upper surface of the roof 14 to provide a readily accessible, easily adjusted, liquid flow control station. It will be noted also that when the pump 36 is inactive, the elevated position of the flow control fitting 38 facilitates gravity clearance of liquid from all of the hose lines 54, 41, 51 and 52. Operation of the pump 36 is controlled by a conventional, exteriorly positioned switch 22 which may be integrated in an enclosure with the light switch 20 for purposes of convenience. A pilot light 24 may be mounted adjacent to a pump switch 22 in conventional manner to indicate energization of the pump electrical circuit (not shown).

The flow control fitting 38 receives water or other liquid 84 under pressure from the pump 36 through the pump discharge line 54 and distributes the liquid through a plurality of outlets under the pressure from a pump. One outlet feeds the nozzle hose fitting 40 through a nozzle control valve 42 wherein the flow of liquid through the nozzle hose 41 to the nozzle 44 may be closely regulated in accordance with the requirements of the job. A second outlet feeds water or liquid under pressure to the wash hose fitting 46 through a suitable control valve 48 whereby the volume of water flowing through the wash hose 52 may be controlled by the operator by regulating the valve 48 in conventional manner. A third outlet 50 supplies water under pressure to the jet return hose 51 for drainage purposes as hereinafter more fully set forth.

The jet return hose 51 runs from the fitting outlet 50 through the apparatus roof 14 and terminates immediately above the junction 78 between the apparatus floor 30 and rear wall 12 in a position overlying the apparatus drain 66. See FIG. 3. It will be noted that the jet return hose 51 is fixed in position to normally overlie and direct its stream downwardly through the apparatus drain opening 66. The absence of a valve at the fitting outlet 50 provides a continuous flow of liquid through the drain opening 66 at all times when the pump 36 is functioning. The effluent of the jet return hose 51 functions to maintain the drain opening 66 clear at all times by breaking any surface tension of the liquid that may have a tendency to form at the drain opening. Additionally, any solid material that may flow to the drain opening 66 will be positively flushed downwardly through the return hose 68, both by forces of gravity and also by the jet action of the effluent from the jet return hose 51. In a preferred embodiment, the end of the jet return hose 51 feeds a capillary tube 86 which is positioned through the drain opening 66 to produce an optimum operating condition whereby positive drainage is assured during all operating periods and any tendency to clog is minimized.

In order to use the hood apparatus 10 of the present invention, the motor 56 is energized in well known manner to turn the buffing or grinding wheel 58 within the interior work space 70 defined within the apparatus. A work piece such as a gold or other precious metal piece, a precious or semi-precious stone or other work piece (not shown) is then introduced into the periphery of the wheel 58 in conventional manner. A deflector shield 60 may be affixed at the open front of the apparatus in well known manner to protect the workman during the polishing or grinding operations.

The nozzle 44 is positioned to emit its effluent directly upon the work piece so that all dust particles or other loose material produced during the grinding, polishing or buffing operations are thoroughly saturated and wet immediately upon separation from the work piece. Both the light switch 20 and the pump switch 22 are activated prior to grinding to shed sufficient light for working purposes upon the work surface and also to direct a stream of water or other liquid 84 from the tank 34 upon the work piece through the nozzle 44. It is contemplated that all dust and other particles when wet will either fall downwardly by gravity upon the tray surface 32 or else will be propelled by action of the wheel 58 in a path indicated by the arrows 88 directly upon the rear wall 12.

The particles propelled against the rear wall will either fall by gravity upon the tray 32 or upon the apparatus floor 30 or else may remain adhered against the interior surface of the rear wall 12. Under such conditions, the manual cleaning hose or wash hose 52 is employed for interior cleaning purposes. As above set forth, liquid 84 from the tank 34 is introduced under pressure to the flow control fitting 38 through the pump discharge line 54. When desired, the wash hose valve 48 can be opened to thereby allow water under pressure from the pump 36 to flow through the wash hose 52. The stream from the wash hose can be manually played about the interior of the apparatus to clean all particles from the rear and side walls 12, 26, 28 and from the top surface of the tray 32. By lifting the tray 32, the floor 30 can be readily exposed for wash down with water from the wash hose 52. All of the wet particles can then be propelled by water under pump pressure rearwardly along the inclined surface of the floor 32 toward the rearwardly positioned junction 78.

The liquid and the entrained dust and particles can then be easily washed along the rear junction 78 toward the drain opening 66 wherein gravity flow through the return hose 68 to the tank 34 can readily occur in the usual manner. As above set forth, the capillary tube 86 outlet of the jet return hose 51 is positioned to continuously direct a jet stream under pump pressure through the drain opening 66 to assure positive flow through the drain opening without clogging. Upon the completion of the interior wash down, the valve 48 can be closed to terminate the flow of water through the wash hose line. Flow will continue through the nozzle 44 and the jet return hose 51. The liquid 84 within the tank 34 can be discharged when desired to leave as a residue at the tank bottom all particles drained during the wash down operations. It is noteworthy that metal dust and other similar particles have a specific weight heavier than water and accordingly the particles will settle by gravity to the bottom of the tank 34 to permit collection when desired.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. In a dust collecting apparatus, the combination of an enclosure comprising a floor, a roof and a back, at least a portion of the back being transparent;

means to direct a flow of liquid interiorly of the enclosure to wet dust particles within the enclosure, said means to direct comprising a water reservoir and a nozzle which directs a stream of water from the reservoir upon the dust;

a drain provided in the enclosure to lead water and entrained dust particles from the enclosure;

a source of illumination to light a working area interorly of the enclosure, the source of illumination being mounted exteriorly of the enclosure in a position to direct light rays interiorly, the said roof slanting forwarding from the back and wherein some of the light rays strike the roof, and the underside of the roof being provided with a reflecting surface.

2. The dust collecting apparatus of claim 1 wherein some of the light rays strike the reflecting surface and are reflected interiorly of the enclosure.

3. The dust collecting apparatus of claim 2 wherein the reflecting surface is a mirror.

4. The dust collecting apparatus of claim 1 wherein the enclosure back slants forwardly.

5. The dust collecting apparatus of claim 4 wherein the roof intersects the back at an angle that is substantially 90°.

6. In a dust collecting apparatus, the combination of an enclosure comprising a floor, a roof and a back;

means to direct a flow of liquid interiorly of the enclosure to wet dust particles within the enclosure, the said means to direct comprising a water reservoir, a flow control fitting and a nozzle which directs a stream of water from the reservoir upon the dust, the flow control fitting including an inlet to receive water from the reservoir and a plurality of outlets;

a first of said outlets supplying water to the nozzle, a drain provided in the enclosure to lead water and entrained dust particles from the enclosure; and a wash hose connected to a second of said outlets, said wash hose being adapted to direct a stream of water from the reservoir about the interior of the closure to wash previously wet dust particles towards the drain.

7. The dust collecting apparatus of claim 6 wherein the nozzle is fixed.

8. The dust collecting apparatus of claim 6 and a valve to control the first outlet to regulate flow of water to the nozzle.

9. The dust collecting apparatus of claim 6 and a valve to control the second outlet to regulate the flow of water through the wash hose.

10. The dust collecting apparatus of claim 6 wherein the flow control fitting comprises a third outlet and wherein a jet return hose connects to the third outlet to direct a stream of water interiorly of the enclosure.

11. The dust collecting apparatus of claim 10 wherein the jet return hose directs its stream upon the drain.

12. The dust collecting apparatus of claim 11 wherein the jet return hose terminates above the drain to define an air gap.

13. The dust collecting apparatus of claim 10 wherein there is no valve to control water flow from the fitting through the jet return hose.

14. The method of collecting precious metal dust particles removed from a workpiece within an enclosure, comprising the steps of directing water on the workpiece to wet the dust;

concentrating the wet dust particles inside of the enclosure;

flushing the wet particles to an enclosure drain;

draining the wet particles and water from an enclosure drain into a collection container; and removing the precious metal particles from the container.

15. The method of claim 14 and the additional step of maintaining the enclosure drain open while draining.

16. The method of claim 15 wherein the maintaining includes flowing liquid through the drain.

17. The method of claim 16 wherein the flowing is continuous with the draining.

* * * * *